US009697811B1

(12) United States Patent
Meliti

(10) Patent No.: US 9,697,811 B1
(45) Date of Patent: Jul. 4, 2017

(54) BASS DRUM CRADLE

(71) Applicant: Michael G. Meliti, Riverside, CT (US)

(72) Inventor: Michael G. Meliti, Riverside, CT (US)

( * ) Notice: Subject to any disclaimer, the term of this patent is extended or adjusted under 35 U.S.C. 154(b) by 0 days.

(21) Appl. No.: 15/213,720

(22) Filed: Jul. 19, 2016

Related U.S. Application Data

(60) Provisional application No. 62/231,891, filed on Jul. 20, 2015.

(51) Int. Cl.
*G10D 13/00* (2006.01)
*G10D 13/02* (2006.01)

(52) U.S. Cl.
CPC ..... *G10D 13/026* (2013.01)

(58) Field of Classification Search
CPC ..... G10D 13/026
USPC ..... 84/421
See application file for complete search history.

(56) References Cited

U.S. PATENT DOCUMENTS 4,829,874 A * 5/1989 Hoshino ..... G10D 13/026 84/421
5,408,913 A 4/1995 Hoshino
5,744,738 A * 4/1998 Gatzen ..... G10D 13/00 248/124.1
5,977,464 A * 11/1999 Bencomo, Jr. ..... G10D 13/026 84/421
6,215,054 B1 4/2001 Lythcott-Haims et al.
7,576,275 B2 * 8/2009 Dixson, Jr. ..... G10D 13/026 84/421
7,645,928 B2 1/2010 Graham
8,022,282 B1 * 9/2011 Burns ..... G10D 13/00 84/421
8,723,008 B1 * 5/2014 Darnell ..... G10D 13/026 84/421
9,217,533 B2 * 12/2015 Mori ..... F16F 15/021
2006/0005689 A1 1/2006 Ito

* cited by examiner

*Primary Examiner* — Jeffrey Donels
(74) *Attorney, Agent, or Firm* — DeLio, Peterson & Curcio, LLC; Thomas E. Ciesco

(57) ABSTRACT

A cradle for supporting a bass drum, the bass drum having a front hoop and a rear hoop disposed on either side of a cylindrical shell, the front and rear hoops being secured against the drum shell by a plurality of drum lugs or connector rods extending along the shell. The cradle comprises a base platform, and front and rear vertical support plates extending from the base platform and having top edges. The cradle includes a plurality of brackets attached to the front and rear vertical support plates along the top edges, the brackets each having an upward facing channel, the brackets and channels being located to removably receive drum lugs or connector rods along a lower side of the shell. The channels of the brackets engage the drum lugs or connector rods along the lower side of shell to support the bass drum.

15 Claims, 6 Drawing Sheets

BASS DRUM CRADLE

CROSS-REFERENCE TO RELATED APPLICATIONS

This application claims the benefit of U.S. Provisional Application Ser. No. 62/231,891, filed Jul. 20, 2015.

BACKGROUND OF THE INVENTION

1. Field of the Invention

The present invention relates generally to bass drums and more specifically to a cradle for mounting a bass drum.

2. Description of Related Art

Bass drums, otherwise known as kick drums that are associated with a drum kit, are usually mounted using a floor stand that consists of two legs which are bolted to a drum shell. The pedal clamps on to the front hoop of the bass drum itself. A perpetual problem that a drummer faces when using a kick drum is the constant movement of the drum as well as stress being put upon the underside. Additionally, the bass drum pedal always damages the hoop to which it was clamped.

The problem with legs on a bass drum is that they put stress on the shell, leading to premature failure of the shell. They prevent the shell from fully resonating. The legs aren't as stable and are tedious to adjust. Additionally, the pedal of the bass drum which is attached to the bass drum hoop often leads to damage to the hoop, wear and tear, and slippage.

Thereafter, several types of restraints and supports were designed to impede the movement of the bass drum while being played. One includes a base plate that includes a center plate and a pair of wings that extend outward from the center; however, these wings still need to be bolted to the drum. Additionally, it does not eliminate the need for the front legs. The base plate solely addresses damage to the front hoop.

SUMMARY OF THE INVENTION

Bearing in mind the problems and deficiencies of the prior art, it is therefore an object of the present invention to provide a support system for a bass drum secured by the lugs of the drum.

It is another object of the present invention to provide a bass drum cradle which provides support between the front and rear lugs of the drum.

A further object of the invention is to provide a cradle for a drum which reduces the pressure put on the drum by its support.

It is yet another object of the present invention to provide a drum cradle which allows the drum to increase resonation of the drum.

It is still another object of the present invention to provide a bass drum cradle which reduces stress on the drum shell.

It is another object of the present invention to provide a bass drum cradle which allows for improved connection of the foot pedal to the bass drum.

Still other objects and advantages of the invention will in part be obvious and will in part be apparent from the specification.

The above and other objects, which will be apparent to those skilled in the art, are achieved in the present invention which is directed to a cradle for supporting a bass drum, the bass drum having a front hoop and a rear hoop disposed on either side of a cylindrical shell, the front and rear hoops being secured against the drum shell by a plurality of drum lugs or connector rods extending along the shell. The cradle comprises a base platform and front and rear vertical support plates extending from the base platform and having top edges. The cradle includes a plurality of brackets attached to the front and rear vertical support plates along the top edges, the brackets each having an upward facing channel, the brackets and channels being located to removably receive drum lugs or connector rods along a lower side of the shell. The channels of the brackets engage the drum lugs or connector rods along the lower side of shell to support the bass drum.

The grooves may be a plurality of rotatable swivel brackets attached to the front or rear vertical support plate and are adjustable toward or away from a drum shell central axis for accommodating various sized bass drums. The cradle may include a pedal mounting assembly having at least one cradle bracket and a pedal bracket mounted to the at least one cradle bracket, the pedal bracket adapted to secure a bass drum pedal relative to the bass drum. The pedal bracket may be adjustable so the bass drum pedal may be moved relative to the bass drum. The bracket may include a threaded rod engagable with a threaded opening in either of the front or rear vertical support plate whereby rotating the bracket in one direction moves the bracket away from the front or rear vertical support plate and rotating the bracket in the opposite direction moves the swivel member closer to the front or rear vertical support plate. The vertical support plates may be affixed to the base plate by an adhesive. The vertical support plates may be affixed to the base plate with fasteners. The vertical support plates may be integral with the base plate. The bass drum cradle may include adjustable feet disposed on the base plate for leveling the bass drum cradle. The brackets may each include a support base secured to either the front or rear vertical support plate and a swivel member rotatably attached to the support base, the swivel member having a channel extending from a back side of the swivel member to a front side of the swivel member.

Another aspect of the invention is directed to a method of supporting a bass drum, the bass drum having a front hoop and a rear hoop disposed on either side of a cylindrical shell, the front and rear hoops being secured against the drum shell by a plurality of bass drum lugs or connector rods extending along the shell. The method comprises providing a cradle having a base platform, front and rear vertical support plates extending from the base platform and having top edges, and a plurality of brackets attached to the front and rear vertical support plates along the top edges, the brackets each having an upward facing channel, the brackets and channels being located to removably receive bass drum lugs or connector rods along a lower side of the shell. The method includes positioning the bass drum above the cradle and engaging the bass drum lugs or connector rods along the lower side of the shell into the channels of the brackets to support the bass drum. The brackets may include a threaded rod extending from a lower surface of the bracket, the threaded rod engagable with a threaded opening in the front and rear vertical support plate and the method may include the step of rotating the bracket to move the bracket toward or away from the front or rear vertical support plate to engage the corresponding bass drum lug or connector rod, the step of rotating the bracket after positioning the bass drum above the cradle. The base platform may include a pedal bracket for attaching a bass drum pedal and the method may include a step of attaching the bass drum pedal to the pedal bracket after engaging the bass drum lugs or connector rods along the lower side of the shell. The swivel member may include a threaded rod engagable with a threaded opening in the support base whereby rotating the swivel member in one direction moves the swivel member away from the support base and rotating the swivel member in the opposite direction moves the swivel member closer to the support base.

Another aspect of the invention is directed to a cradle for supporting a bass drum, the cradle comprising a horizontal base platform, a front vertical support plate having a front support curved top edge corresponding to a front hoop of the bass drum and a rear vertical support plate having a rear support curved top edge corresponding to a rear hoop of the bass drum. The cradle includes a plurality of front swivel brackets attached to the front support curved top edge and a plurality of rear swivel brackets attached to the rear support curved top edge, the front and rear swivel brackets each having a support base secured to either the front support curved top edge or rear support curved top edge and a swivel member rotatably attached to the support base. The swivel member includes a channel extending from a back side of the swivel member to a front side of the swivel member. The bass drum front hoop and the bass drum rear hoop are disposed on either side of a cylindrical shell having a diameter and a length, and are held against the drum shell by a plurality of connector rods extending parallel to the cylinder length. The connector rods each have a front rod end and a rear rod end, the front rod end engagable with at least one of the front swivel bracket swivel member channels and the rear rod end engagable with at least one of the rear swivel member channels, whereby the bass drum is supported the connector rods along the swivel member groove. The cradle may include a pedal mounting assembly having at least one cradle bracket and a pedal bracket adjustable mounted to the at least one cradle bracket, the pedal bracket adapted to secure a bass drum pedal relative to the bass drum. The swivel member may include a threaded rod engagable with a threaded opening in the support base whereby rotating the swivel member in one direction moves the swivel member away from the support base and rotating the swivel member in the opposite direction moves the swivel member closer to the support base.

Another aspect of the invention is directed to a bass drum cradle for supporting a bass drum pedal, the bass drum cradle comprising a support base for securing a bass drum thereto and a pedal mounting bracket having a vertical member and a horizontal member extending from the vertical member, the pedal mounting bracket attached to the support base. The bass drum cradle includes at least one slotted opening in either the vertical member or the horizontal member of the pedal mounting bracket wherein a bass drum pedal may be mounted to the pedal mounting bracket, the pedal adjustable relative to the bass drum.

Another aspect of the invention is directed to a bass drum cradle for supporting a bass drum pedal, the bass drum cradle comprising a support base for securing a bass drum thereto and at least one pedal mounting bracket having a vertical member and a horizontal member extending from the vertical member, the pedal mounting bracket attached to the support base. The bass drum cradle includes a slotted opening in the horizontal member of the pedal mounting bracket. The bass drum cradle includes a pedal adjustment bar for attaching the bass drum pedal, the pedal adjustment bar being slidably attached to the pedal mounting bracket to move the bass drum pedal toward or away from the bass drum and a fastener for adjustable securing the pedal adjustment bar to the horizontal member of the pedal mounting bracket. The fastener extends through an opening on the pedal adjustment bar and through the slotted opening in the horizontal member of the pedal mounting bracket. The bass drum pedal may be mounted to the pedal mounting bracket, the pedal adjustable relative to the bass drum.

Another aspect of the invention is directed to a bass drum cradle for supporting a bass drum pedal, the bass drum cradle comprising a support base for securing a bass drum thereto; and a plurality of leveling feet adjustably attached to the support base. The leveling feet include a threaded receiver disposed on the support base and a conical leg having a threaded post extending upwardly rotatably engaging the threaded receiver wherein the conical leg includes a downwardly pointing apex. Rotation of the conical leg in one direction retracts the conical leg toward the support base and rotation of the conical leg in the opposite direction extends the conical leg away from the support base.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
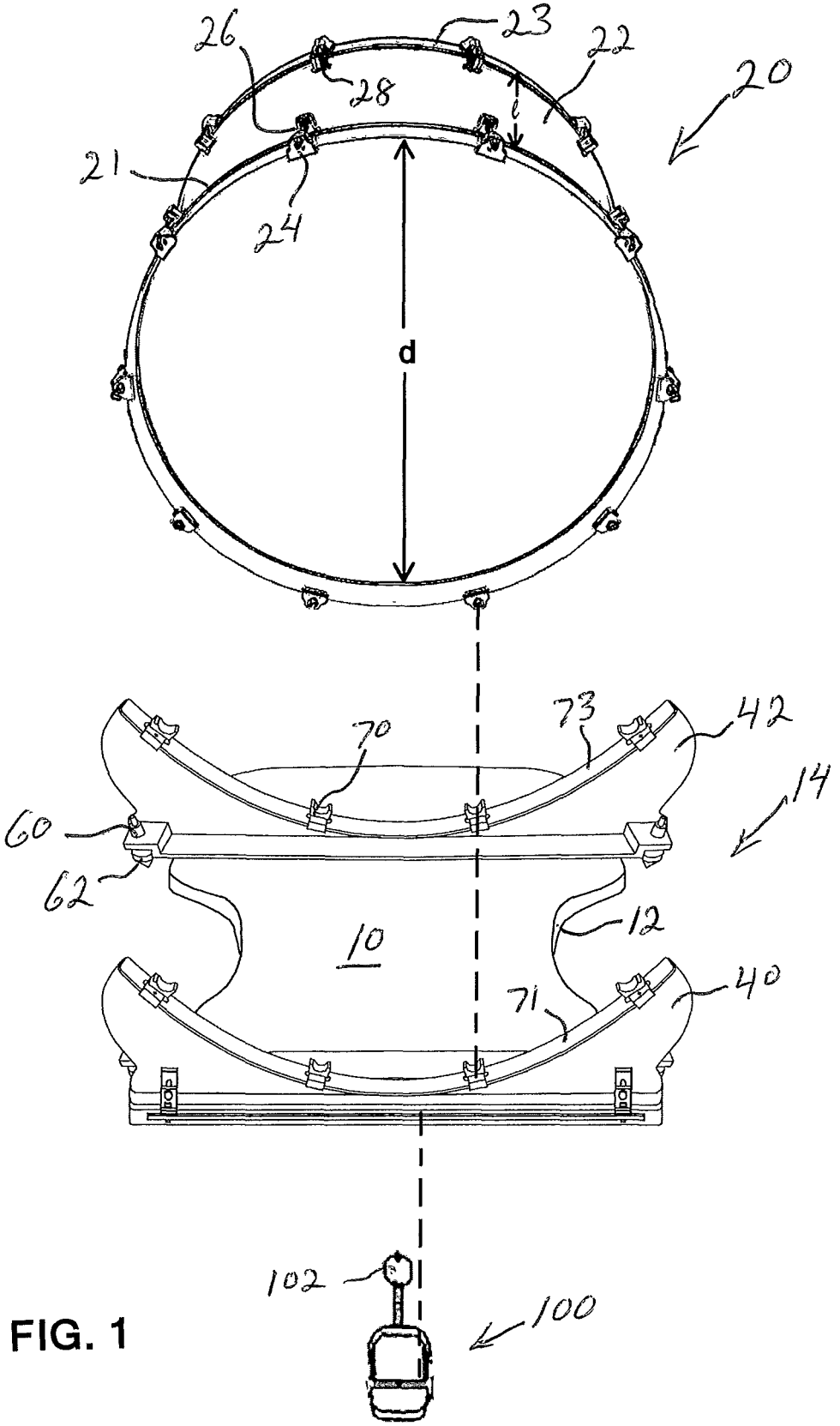
FIG. 1 is a front exploded perspective view of the bass drum cradle according to the present invention.

In describing the preferred embodiment of the present invention, reference will be made herein to FIGS. 1-10 of the drawings in which like numerals refer to like features of the invention.

The drawings depict an example of the present invention wherein bass drum cradle 14 holds the bass drum 20 by the bass drum lugs 28 or the connector rods 26 instead of supporting the bass drum by legs attached to the bass drum shell 22. The connector rods 26 may be lug posts extending from the drum lug to the claw hook. The bass drum 20 rests on the cradle 14 by the bass drum lugs 28 which engage a plurality of swivel brackets 70 rotatably attached to the cradle 14. The bass drum cradle 14 holds the bass drum 20 in place between the front and rear lugs 28 of the bass drum 20 by the weight of the bass drum. The pressure holding the bass drum 20 in the cradle is put on the rods 26 and/or lugs 28 rather than on the shell 22 of the bass drum 20. The cradle 14 provides more stability to the bass drum 20 as well as allowing the bass drum 20 to resonate more. Since the bass drum 20 is no longer resting directly on the floor, there is less transfer of energy from drum to floor. The cradle 14 also provides a more secure system for mounting the bass drum pedal 100 to the bass drum 20. The cradle 14 includes a pedal attachment bar 34 that is attached to the pedal 100.

Figure 2:
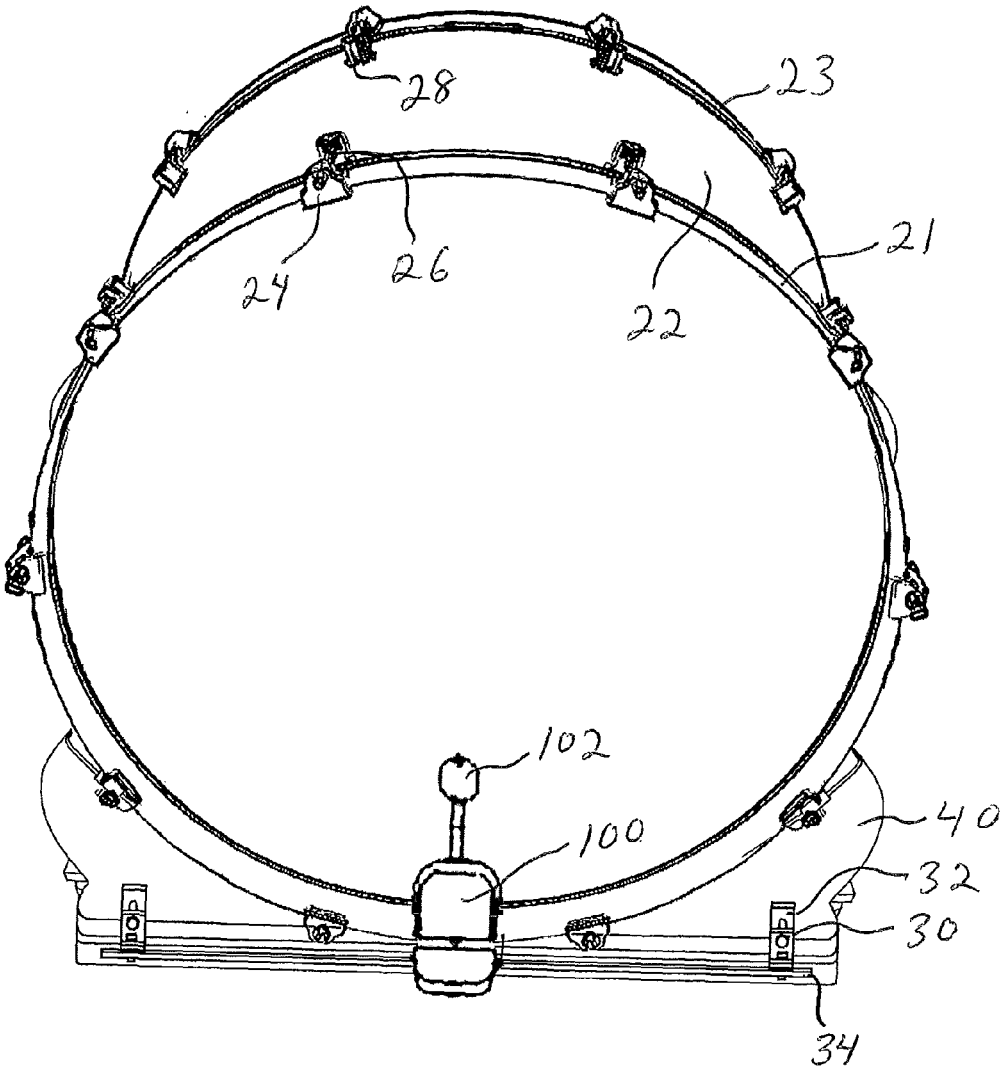
FIG. 2 is a front perspective view of the assembled bass drum cradle system according to the present invention.
Figure 3:
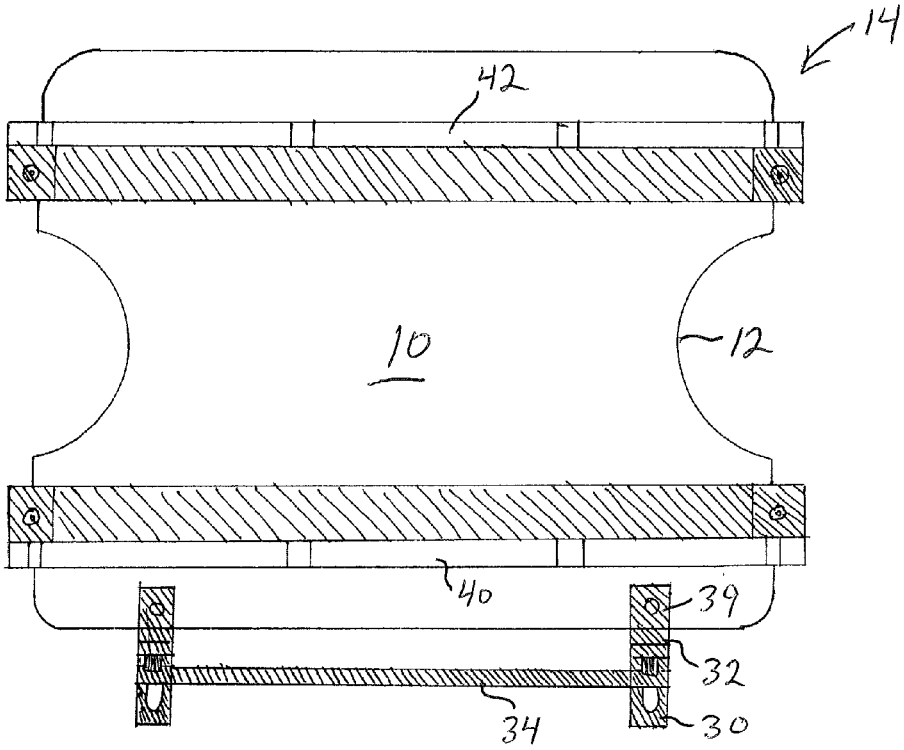
FIG. 3 is a top elevational view of the bass drum cradle shown in FIG. 1.
Figure 4:
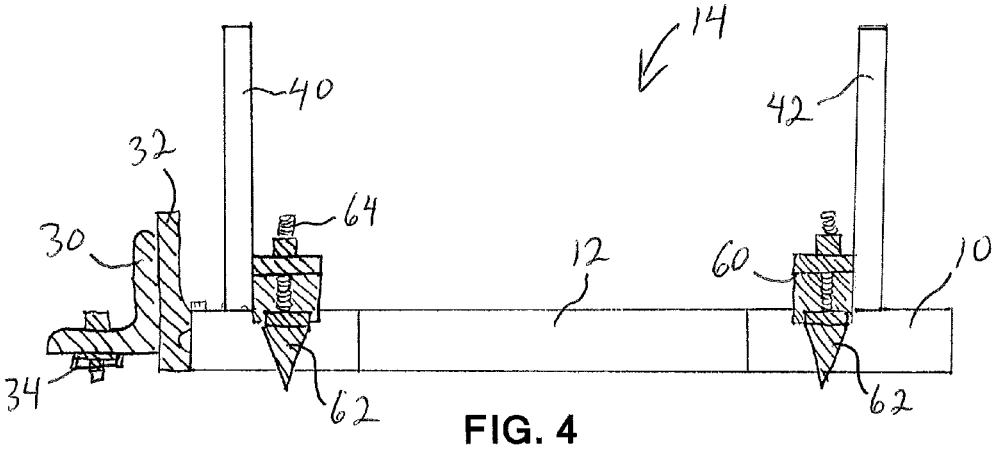
FIG. 4 is a side elevational view of the bass drum cradle shown in FIG. 1.
Figure 5:
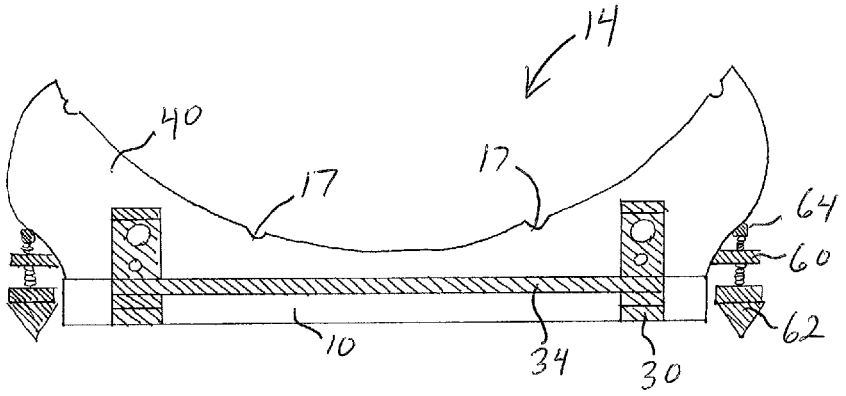
FIG. 5 is a front elevational view of the bass drum cradle shown in FIG. 1.
Figure 6:
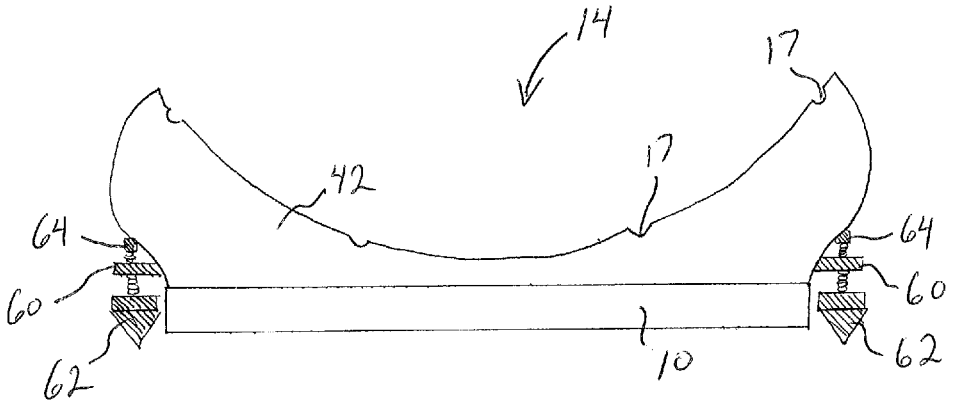
FIG. 6 is a rear elevational view of the bass drum cradle showing an alternate feature for attaching the bass drum to the cradle.

FIG. 1 is a front exploded perspective view of the bass drum 20 engagable with the cradle 14. FIG. 2 shows the bass drum 20, cradle 14 and foot pedal 100 of FIG. 1 assembled. FIG. 3 shows a top view of the cradle 14 and FIGS. 4-6 shows side, front and rear views of the cradle 14. A foot pedal 100 is attachable to a pedal attachment bar 34 on the bass drum cradle 14. The bass drum 20 includes a front hoop 21 and a rear hoop 23 disposed on either side of a cylindrical shell 22. The front hoop 21 and rear hoop 23 are secured against the drum shell 22 by a plurality of claw hooks 24 and mounting lugs 28 extending along the shell 22. Tension rods or connecting rods 26 extending from the claw hooks 24 are adjustably secured to the mounting lugs 28 for tension adjustment. The pedal attachment bar 34 may be aluminum and is adjustable in an upward, downward, forward, and backward direction to accommodate various sized pedals. The cradle 14 includes a plurality of foot brackets 60 and spiked leveling feet 62 which are adjustable to change the height of the cradle 14 and to accommodate a floor or ground which is not level or flat. The leveling feet 62 may alternately have a less sharp spike to prevent any damage to the floor. The cradle 14 includes bass drum swivel brackets 70 which are adjustable for engaging bass drums of various radii (for example, bass drums having a radius of 18, 20, 22 or 24 inches). The adjustable leveling feet 62 may terminate at the bottom end in a sharp point to prevent the cradle 14 from moving or sliding on a carpet or wood floor. FIG. 4 shows a side view of the cradle 14 and spiked feet 62 with a threaded post 64 to adjust the height and level of the cradle 14. A radius or notch 12 is disposed in the cradle bottom plate 10 which allows room for cymbal stands and reduces the footprint of the overall cradle 14.

The cradle base plate 10 may be aluminum or other material which provides adequate stability. A plurality of threaded foot brackets 60 having adjustable spiked leveling feet 62 are mounted to the cradle 10. In one embodiment shown in FIGS. 5 and 6, four recesses or notches 17 are disposed on the front and rear vertical support plates 40, 42 extending upward from the base plate 10. The base plate 10 may have a radius 12 cut out that allows for placement of cymbal stands close to the bass drum, giving the cradle 14 a smaller footprint. For attaching the pedal 100 to the cradle 14, a slotted L-bracket 30 is mounted to a pedal height attachment bar 34. The pedal height adjustment bar 34 is adjustable in height along the slotted L-bracket 30. The L-bracket 30 shown in FIGS. 9 and 10 has a horizontal slotted opening 37 on the bottom horizontal member 35 to allow the pedal attachment bar 34 to slide toward and away from the bass drum 20 when the pedal attachment bar fastener 38 is in a loosened position. Tightening the pedal attachment bar fastener 38 secures the pedal attachment bar to the L-bracket 30.

FIG. 2 shows the bass drum cradle for supporting the bass drum 20 and foot pedal 100. FIGS. 3-5 show elevational views of the bass drum cradle 14. The bass drum cradle 14 comprises a horizontal base platform 10, a front vertical support plate 40 having a front support curved top edge corresponding to the front hoop 90 of the bass drum and a rear vertical support plate 42 having a rear support curved top edge corresponding to the rear hoop of the bass drum 92. The bass drum cradle 14 may include a plurality of swivel brackets 70 attached to the front support 40 on a front curved top edge and to the rear support 42 on a rear curved top edge. The bass drum front hoop 21 and the bass drum rear hoop 23 are disposed on either side of the bass drum cylindrical shell 22. The cylindrical shell 22 has a length l, and a diameter d.

A plurality of cradle grooves 17 may extend from a front side of the vertical support plates 40, 42 to the rear side of the vertical support plates 40, 42 which are positioned to engage the bass drum connecting rods and/or the lugs. Additional cradle grooves may be added to allow for various sized bass drums. The radius of the front and rear vertical support plates 40, 42 may be sized to fit a particular drum.

Bass drum lugs 28 are attached to the drum shell 22. Tension rods or connector rods 26 may be threaded into each lug 28. Lugs 28 on the bass drum shell 22 may rest on notches 7 shown in FIGS. 5 and 6 or on swivel brackets 70 shown in FIGS. 1 and 7.

Figure 7:
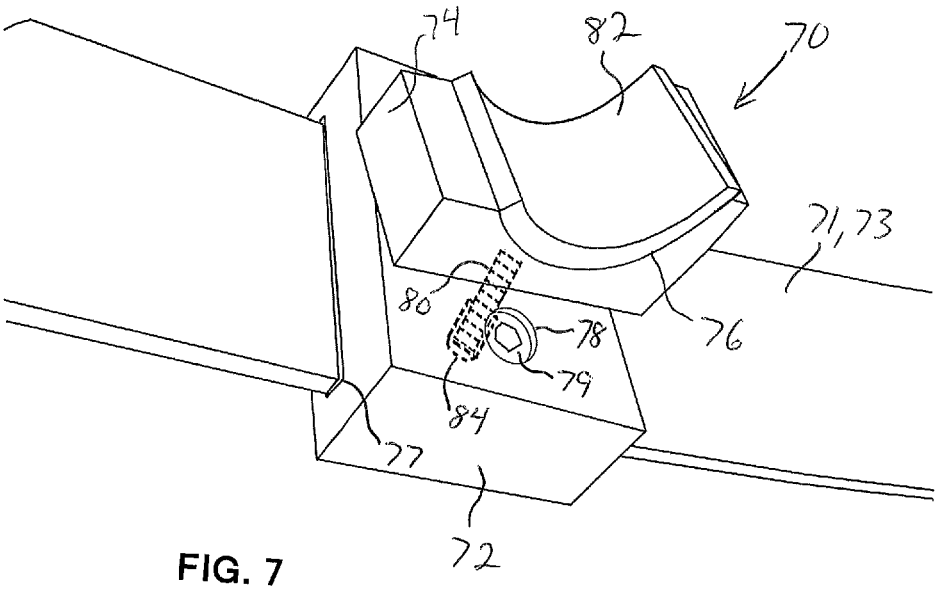
FIG. 7 is a perspective view of the swivel bracket according to the present invention.

As shown in FIG. 7, swivel brackets 70 may be used to attach the mounting lug 28 or tension rod 26 to the bass drum cradle 14. Each swivel bracket 70 includes a support base 72 secured to either the front support 40 curved top edge 71 or rear support 42 curved top edge 73. A swivel member 74 is rotatably attached to the support base 72, the swivel member 74 having a channel 76 extending from a back side of the swivel member 74 to a front side of the swivel member 74. The swivel bracket 70 includes a swivel member threaded rod 80 engagable with a support base threaded opening 84. The support base 72 may include a support base slot 78 for engaging the curved top edge 71 or the curved top edge 73 or curved top edge 72 so the support base 72 may slide along the curved top edge 71. A set screw 79 may engage a set screw opening 78 on the support base 72 to secure the support base 72 on a specific location or the curved top edge 71 or curved top edge 73. The swivel member 74 includes a swivel member groove 76 and may include a dampening insert 82 for preventing damage to the bass drum lugs 28 or tension rods or connecting rods 26. The swivel member 74 may have one of the edges longer than the other so that the swivel members disposed higher on the vertical support member 40, 42 may allow for easier placement of the drum mounting rods 26 or lugs 28 in compensating for the angle which the swivel member 74 is disposed on the curved top edge 71 or curved top edge 72.

Figure 8:
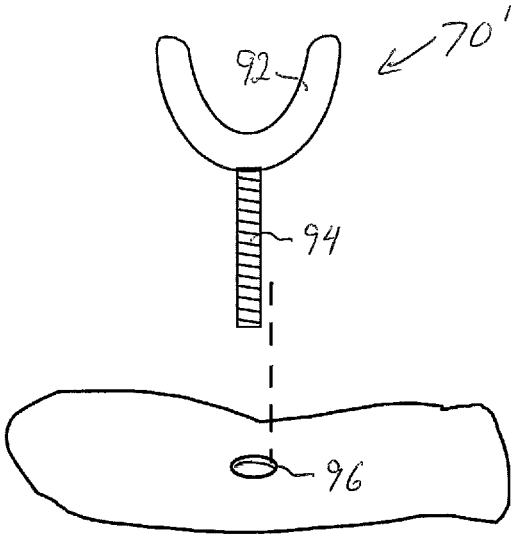
FIG. 8 is a perspective view of an alternate embodiment of the swivel bracket according to the present invention.

FIG. 8 shows an alternate embodiment of the swivel bracket 70'. The swivel bracket 70' includes a lug saddle 92 and a threaded saddle rod 94 engagable with the bass drum lugs extending from a lower end of the lug saddle 92. The threaded saddle rod 94 is engagable with a lug connector opening 96 in the front and rear vertical support plates 40, 42. The lug connector 90 moves toward the front or rear vertical support plate 40, 42 to which it is connected when the lug connector is rotated in one direction and moves away from the front or rear support plate when rotated in the opposite direction.

Figure 9:
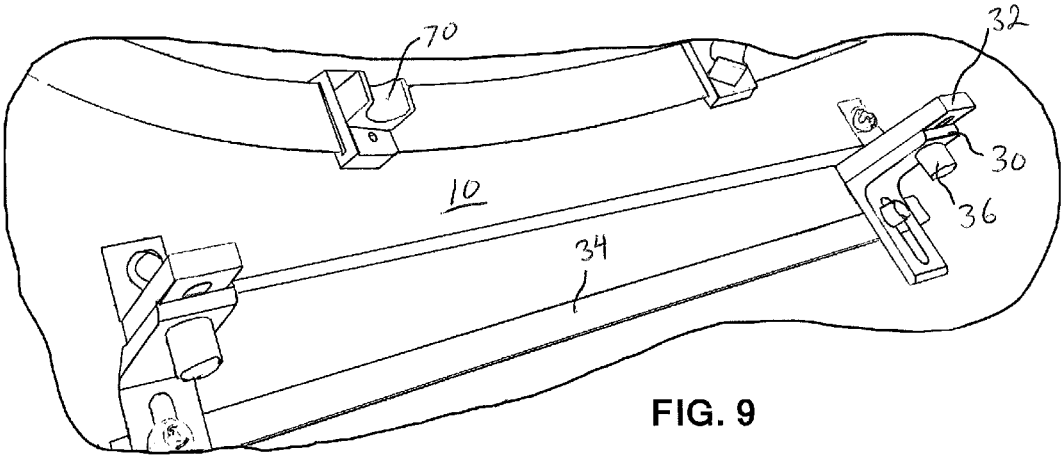
FIG. 9 is a perspective view of the foot pedal adjustment bar, L-bracket and height adjustment bracket according to the present invention.
Figure 10:
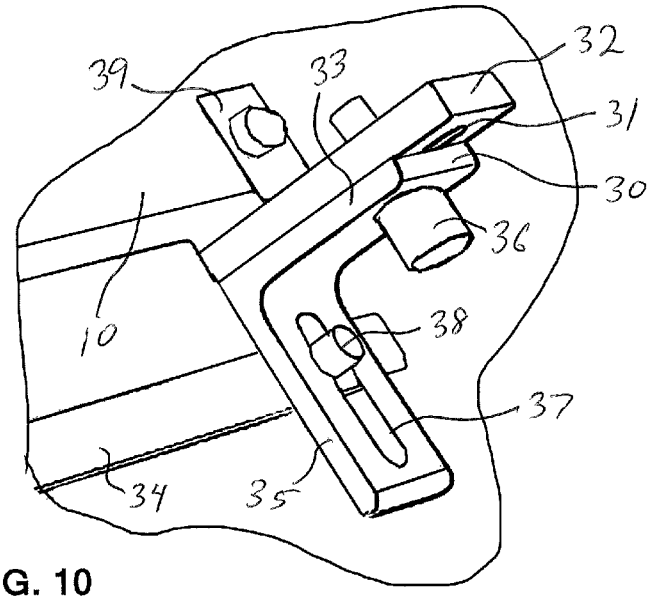
FIG. 10 is an enlarged perspective view of the L-bracket and height adjustment bracket shown in FIG. 9.

FIGS. 9 and 10 show a perspective view and enlarged view of a system for mounting and adjusting the foot pedal. A pedal height adjustment bracket 32 is secured to the cradle base plate 10. Mounting may be accomplished using a secondary bracket 39 secured to both the base plate and the pedal height adjustment bracket 32 or the pedal height adjustment bracket 32 may be directly secured to the base plate 10. A height adjustment slotted opening 31 engages a height adjustment fastener 36 which extends through a vertical member 33 of a slotted L-bracket 30. When the height adjustment fastener 36 is in a loosened position, the slotted L-bracket may be moved in an upward or downward direction with respect to the base plate 10 and the height adjustment bracket 32 and when the height adjustment fastener 36 is in a tightened position, the slotted L-bracket 30 is stationary with respect to the base plate 10 and the height adjustment bracket 32. A pedal adjustment bar 34 is releasably secured to a horizontal member 35 of the slotted L-bracket 30 with depth fastener 38. When the depth fastener 38 is in a loosened position, the pedal attachment bar may be moved toward or away from the base plate 10, which changes the depth or proximity of the foot pedal with respect to the base plate, adjusting the striking angle of the foot pedal head against the bass drum. Preferably, physical adjustment to the height and depth of the pedal attachment bar is substantially the same for both the left and right sides of the pedal attachment bar 34.

Referring back to FIG. 1, in a method of supporting a bass drum on the cradle, the method includes positioning the bass drum above the cradle and rotating the swivel brackets to engage the connector rods or lugs along the lower side of the shell into the channels of the brackets to support the bass drum. The swivel brackets may be pre-adjusted by estimating the location by eye or by experience so minimal adjustment is necessary while positioning the bass drum above the cradle. The method includes inserting the bass drum rods or lugs into the channels of the brackets to secure the bass drum to the saddle. The method may include attaching the foot pedal to the pedal attachment bar and adjusting the pedal attachment bar or the pedal to properly strike the drum.

The present invention overcomes the problems associated with prior art. The present invention does this by cradling and holding the bass drum in place for better stability, resonance, and isolation, all while putting less pressure and wear and tear on the drum. The purpose of the cradle is to hold the bass drum instead of legs that usually keep it in place. The drum now sits on the cradle by resting on the connecting rods or lugs of the drum. It holds the drum in place between the front and rear lugs. As a result, no pressure is being put upon the drum. It makes the drum more stable and allows it to resonate more. Since the drum is no longer resting on the floor, there is less transfer of energy from drum to floor. The problem with legs on a bass drum is that they put stress on the shell, leading to premature failure of the shell. They prevent the shell from fully resonating. The legs aren't as stable and are tedious to adjust. The cradle also solves the problem of attaching the bass drum pedal to the bass drum hoop. The pedal often leads to damage to the hoop, wear and tear, and slippage. The cradle helps address these problems by including a bracket that is attached to the pedal.

The bass drum cradle provides a support system for whereby a bass drum is secured by the lugs of the drum and provides support between the front and rear lugs of the drum. The bass drum cradle reduces the pressure put on the drum and allows the drum to increase resonation of the drum.

The bass drum cradle reduces stress on the drum shell. The bass drum cradle allows for improved connection of the foot pedal to the bass drum.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A cradle for supporting a bass drum, the bass drum having a front hoop and a rear hoop disposed on either side of a cylindrical shell, the front and rear hoops being secured against the drum shell by a plurality of drum lugs or connector rods extending along the shell, the cradle comprising:

a base platform;

front and rear vertical support plates extending from the base platform and having top-edges; and a plurality of rotatable swivel brackets attached to the front and rear vertical support plates along the top edges, the brackets each having an upward facing channel, the brackets and channels being located to removably receive drum lugs or connector rods along a lower side of the shell, the channels of the brackets engaging the drum lugs or connector rods along the lower side of shell to support the bass drum;

wherein the brackets are adjustable toward or away from a drum shell central axis for accommodating various sized bass drums.

2. The cradle of claim 1 including a pedal mounting assembly having at least one cradle bracket and a pedal bracket mounted to the at least one cradle bracket, the pedal bracket adapted to secure a bass drum pedal relative to the bass drum.

3. The cradle of claim 2 wherein the pedal bracket is adjustable so the bass drum pedal may be moved relative to the bass drum.

4. A cradle for supporting a bass drum, the bass drum having a front hoop and a rear hoop disposed on either side of a cylindrical shell, the front and rear hoops being secured against the drum shell by a plurality of drum lugs or connector rods extending along the shell, the cradle comprising:

a base platform;

front and rear vertical support plates extending from the base platform and having top edges; and a plurality of brackets attached to the front and rear vertical support plates along the top edges, the brackets each having an upward facing channel, the brackets and channels being located to removably receive drum lugs or connector rods along a lower side of the shell, the channels of the brackets engaging the drum lugs or connector rods along the lower side of shell to support the bass drum;

wherein the bracket includes a threaded rod engagable with a threaded opening in either of the front or rear vertical support plate whereby rotating the bracket in one direction moves the bracket away from the front or rear vertical support plate and rotating the bracket in the opposite direction moves the swivel member closer to the front or rear vertical support plate.

5. The bass drum cradle of claim 1 wherein the vertical support plates are affixed to the base plate by an adhesive.

6. The bass drum cradle of claim 1 wherein the vertical support plates are affixed to the base plate with fasteners.

7. The bass drum cradle of claim 1 wherein the vertical support plates are integral with the base plate.

8. The bass drum cradle of claim 1 including adjustable feet disposed on the base plate for leveling the bass drum cradle.

9. The bass drum of claim 1 wherein the brackets each include a support base secured to either the front or rear vertical support plate the swivel member rotatably attached to the support base and having a channel extending from a back side of the swivel member to a front side of the swivel member.

10. A method of supporting a bass drum, the bass drum having a front hoop and a rear hoop disposed on either side of a cylindrical shell, the front and rear hoops being secured against the drum shell by a plurality of bass drum lugs or connector rods extending along the shell, the method comprising:

providing a cradle having a base platform, front and rear vertical support plates extending from the base platform and having top edges, and a plurality of brackets attached to the front and rear vertical support plates along the top edges, the brackets each having an upward facing channel, the brackets and channels being located to removably receive bass drum lugs or connector rods along a lower side of the shell;

positioning the bass drum above the cradle; and engaging the bass drum lugs or connector rods along the lower side of the shell into the channels of the brackets to support the bass drum;

wherein the brackets include a threaded rod extending from a lower surface of the bracket, the threaded rod engagable with a threaded opening in the front and rear vertical support plate, the method including the step of rotating the bracket to move the bracket toward or away from the front or rear vertical support plate to engage the corresponding bass drum lug or connector rod, the step of rotating the bracket after positioning the bass drum above the cradle.

11. The method of claim 10 wherein the base platform includes a pedal bracket for attaching a bass drum pedal and including a step of attaching the bass drum pedal to the pedal bracket after engaging the bass drum lugs or connector rods along the lower side of the shell.

12. The method of claim 10 wherein the swivel member includes a threaded rod engagable with a threaded opening in the support base whereby rotating the swivel member in one direction moves the swivel member away from the support base and rotating the swivel member in the opposite direction moves the swivel member closer to the support base.

13. A cradle for supporting a bass drum, the cradle comprising:

a horizontal base platform;

a front vertical support plate having a front support curved top edge corresponding to a front hoop of the bass drum;

a rear vertical support plate having a rear support curved top edge corresponding to a rear hoop of the bass drum; and a plurality of front swivel brackets attached to the front support curved top edge and a plurality of rear swivel brackets attached to the rear support curved top edge, the front and rear swivel brackets each having a support base secured to either the front support curved top edge or rear support curved top edge and a swivel member rotatably attached to the support base, the swivel member having a channel extending from a back side of the swivel member to a front side of the swivel member;

wherein the bass drum front hoop and the bass drum rear hoop are disposed on either side of a cylindrical shell having a diameter and a length, and are held against the drum shell by a plurality of connector rods extending parallel to the cylinder length; and wherein the connector rods each have a front rod end and a rear rod end, the front rod end engagable with at least one of the front swivel bracket swivel member channels and the rear rod end engagable with at least one of the rear swivel member channels, whereby the bass drum is supported the connector rods along the swivel member groove.

14. The cradle of claim 13 including a pedal mounting assembly having at least one cradle bracket and a pedal bracket adjustable mounted to the at least one cradle bracket, the pedal bracket adapted to secure a bass drum pedal relative to the bass drum.

15. The cradle of claim 13 wherein the swivel member includes a threaded rod engagable with a threaded opening in the support base whereby rotating the swivel member in one direction moves the swivel member away from the support base and rotating the swivel member in the opposite direction moves the swivel member closer to the support base.

* * * * *